US008176589B2

(12) United States Patent
Stjerna et al.

(10) Patent No.: US 8,176,589 B2
(45) Date of Patent: May 15, 2012

(54) POCKET SPRING MATTRESS, A METHOD AND A DEVICE FOR THE MANUFACTURING THEREOF

(75) Inventors: Nils Eric Stjerna, Herrljunga (SE); Kenneth Edling, Herrljunga (SE)

(73) Assignee: Stjernfjadrar AB, Herrljunga (SE)

( * ) Notice: Subject to any disclaimer, the term of this patent is extended or adjusted under 35 U.S.C. 154(b) by 389 days.

(21) Appl. No.: 12/448,562

(22) PCT Filed: Jan. 11, 2008

(86) PCT No.: PCT/SE2008/000023

§ 371 (c)(1),
(2), (4) Date: Sep. 2, 2009

(87) PCT Pub. No.: WO2008/085120

PCT Pub. Date: Jul. 17, 2008

(65) Prior Publication Data

US 2010/0011509 A1 Jan. 21, 2010

(30) Foreign Application Priority Data

Jan. 12, 2007 (SE) ..... 0700049

(51) Int. Cl.
*A47C 27/07* (2006.01)
*B68G 9/00* (2006.01)

(52) U.S. Cl. ..... 5/720; 5/716; 5/655.8; 53/114; 140/3 CA

(58) Field of Classification Search ..... 5/716, 720, 5/727, 655.8; 140/3 CA; 53/114; 267/81, 267/82, 89, 90, 93; 29/91.1
See application file for complete search history.

(56) References Cited

U.S. PATENT DOCUMENTS

| | | | | |
|---|---|---|---|---|
| 1,053,675 | A | 2/1913 | Suekoff, Jr. | |
| 1,455,847 | A | 5/1923 | Meutsch | |
| 4,578,834 | A * | 4/1986 | Stumpf | 5/720 |
| 5,924,681 | A | 7/1999 | Bullard | |
| 6,021,627 | A * | 2/2000 | Mossbeck et al. | 53/438 |
| 6,122,900 | A * | 9/2000 | Mossbeck et al. | 53/529 |
| 6,315,275 | B1 * | 11/2001 | Zysman | 267/89 |
| 7,194,777 | B2 * | 3/2007 | Edling et al. | 5/720 |
| 7,748,065 | B2 * | 7/2010 | Edling | 5/720 |
| 2008/0282476 | A1 * | 11/2008 | Lundevall | 5/720 |
| 2010/0212090 | A1 * | 8/2010 | Stjerna | 5/720 |

FOREIGN PATENT DOCUMENTS

DE 44 35 771 4/1996

(Continued)

OTHER PUBLICATIONS

Supplementary European Search Report dated Dec. 12, 2011.

*Primary Examiner* — Michael Trettel
(74) *Attorney, Agent, or Firm* — Harness, Dickey & Pierce, P.L.C.

(57) ABSTRACT

A spring mattress is disclosed including a plurality of strings interconnected side by side, each string including a plurality of continuous casings and each casing including a coil spring. Further, in at least one embodiment, at least one of the casings in at least one of the strings includes a plurality of stretch openings into the interior of the casing, wherein at least some of said stretch openings are displaced in relation to each other in a lengthwise direction of the spring. At least one embodiment of the present invention also relates to a method and a device for manufacturing of such a mattress, as well as to a bed adapted for such a mattress.

31 Claims, 6 Drawing Sheets

FOREIGN PATENT DOCUMENTS

| | | |
|---|---|---|
| EP | 1 707 081 | 10/2006 |
| JP | 2001-340175 | 12/2001 |
| WO | WO 02/44077 | 6/2002 |
| WO | WO 2005/055771 | 6/2005 |
| WO | WO 2005/102115 | 11/2005 |
| WO | WO 2007/102772 | 9/2007 |

* cited by examiner

POCKET SPRING MATTRESS, A METHOD AND A DEVICE FOR THE MANUFACTURING THEREOF

TECHNICAL FIELD OF THE INVENTION

The present invention relates to a spring mattress comprising a plurality of strings interconnected side by side, each string comprising a plurality of continuous casings and each casing comprising a coil spring. The present invention also relates to a method and a device for manufacturing of such a mattress, as well as to a bed adapted for such a mattress.

BACKGROUND ART

A common technique of making spring mattresses is the so-called pocket technique. This means that the springs are enclosed in pockets, i.e. they are individually enclosed by a casing material. In this way, the springs will be relatively individually resilient so that they can flex individually without affecting the neighboring springs and, thus, the comfort for the user increases since his weight will be distributed more uniformly over the surface that receives the load.

A drawback of such mattresses is, however, that they are significantly more expensive to manufacture than many other types of spring mattresses, and since a considerable amount of casing fabric is required to enclose each spring individually. It is therefore desirable, without lowering the mattress's standards of quality, to reduce the amount of fabric. Additionally, the fabric of which the pocket casings can be made, can vary in quality and consequently vary in cost. However, if fabrics of lower quality are used, a rustling noise is known to arise as the casing along with the spring is flexed under load. The rustling can be audible to the user of the mattress, causing him discomfort, and consequently, more expensive fabrics are preferred and are therefore adding to the overall cost. Thus, to be able to use a less expensive casing fabric, there is a need for eliminating or diminishing the rustling problem during ordinary use of the mattress.

Taken together, there is a need for a mattress which is easier and/or less expensive to manufacture but which at the same time provides at least an equivalent comfort compared with other prior-art pocket mattresses. The drawbacks are partly eliminated by the mattress disclosed in WO 02/44077 by the same applicant. This mattress comprises strings, in which the springs are more separated than has been known so far. This has been found not only economically advantageous, but the mattress has also been found to be comfortable to the same extent as prior-art mattresses. However, in this solution it is still difficult to obtain the desired individual resilience of the individual springs. Additionally, the attempt to benefit from less expensive casing fabrics remains as well as the attempt to reduce the considerable amount of casing fabrics required to enclose each spring individually. It is therefore still a need for a more cost effective and/or more comfortable mattress.

SUMMARY OF THE INVENTION

It is therefore an object of the present invention to provide a spring mattress of the type mentioned by way of introduction, a method and device for manufacturing the same, and a bed adapted for such mattress, in which the above related drawbacks are eliminated wholly or at least partly.

According to a first aspect of the invention, a spring mattress is provided comprising a plurality of strings interconnected side by side, each string comprising a plurality of continuous casings and each casing comprising a coil spring.

At least one of the casings in at least one of the strings comprises a plurality of stretch openings into the interior of the casing, and at least some of the stretch openings are displaced in relation to each other in a lengthwise direction of the spring.

The invention is likewise related to a method of manufacturing a mattress of the kind defined above. Thus, according to a second aspect of the invention, there is provided a method comprising the steps of:

enclosing springs in casings in continuous strings;

interconnecting the strings side by side; and providing at least one of the casings in at least one of the strings with a plurality of stretch openings into the interior of the casing. At least some of the stretch openings are displaced in relation to each other in a lengthwise direction of the spring.

Additionally, the invention is also related to a device for manufacturing of a mattress of the kind defined above, why according to a third aspect of the invention there is provided a said device comprising:

means for enclosing coil springs in continuous casings to form strings;

means for interconnecting strings side by side; and means for providing at least one of the casings in at least one of the strings with a plurality of stretch openings into the interior of the casing. At least some of the stretch openings are displaced in relation to each other in a lengthwise direction of the spring.

In the content of the present application, stretch openings refers to openings of any form or shape enabling the casing to stretch in at least one direction.

As a result of the pocket casings comprising a plurality of stretch openings, less casing fabric is used. This is at least partly due to the stretch openings contributing to increased stretching characteristics of the casing material holding the spring. Less casing fabric is thereby needed in a lengthwise direction of the spring to obtain stretching characteristics equivalent to a casing lacking such stretch openings. Thus, less material is required for each casing comprising stretch openings, and consequently, the stretch openings contribute to obtaining cost savings.

Additionally, it has surprisingly been found by the present inventors that the plurality of casing stretch openings contributes to reducing rustling noises during flexing of the casing along with the spring during load. Probably, this is due to less fabric being compressed. In prior art, less expensive casing fabrics have been known to cause rustling noises audible to the user of the mattress, during ordinary use. Consequently, less expensive fabrics, have hitherto been unsuitable as choice of casing material. With the diminishing of the rustling problem by means of the present invention, however, less expensive fabrics can be used without exposing the user of the mattress to audible rustling noises to the same extent. Thus, with the invention, a reduction of rustling noises will be achieved for any material compared to when the same fabric used in spring mattresses of prior art. Thus, it is possible to use a less expensive fabric to obtain a rustling noise level comparable to that of a conventional casing with a more expensive fabric, or, use a more expensive fabric and thereby lower the rustling noise level compared to the level of the same material used in a previously known mattress.

Yet another advantage arising with the plurality of casing stretch openings, is that the casing will be more individually flexible during spring load. By means of the present invention, casings adjacent to casings/springs exposed to load stretch more easily, resulting in the adjacent springs being less affected by said load. Consequently, with the provision of stretch openings in accordance with the invention, improvements are achieved with regards to individual resilience of the springs.

Still another effect arising with the provision of a plurality of casing stretch openings, is that this allows the springs of the strings to be more separated from each other. Surprisingly it has been found by the inventors, that separating the strings more than what has been known so far, does not reduce the comfort of the mattress. The properties of the mattress are not noticeable affected from being less compact but essentially the same qualities of comfort are achieved in the inventive mattress as in conventional pocket-spring mattresses. In fact, it has been found that in some cases the increased distance between the strings adds to the individual resilience of the spring, which increases comfort, since each individual spring is able to support loads comparatively independently. This is in analogy with the findings of WO 02/44077 by the same applicant, in which the springs are separated within each string. Due to the stretch openings contributing to that the covers stretch more easily, the present invention allows the interconnected strings to be more separated. The possibility to stretch the covers in their interconnection with adjacent strings and the improved individual cover resilience contribute to less strings being required for maintaining the same comfort as experienced in mattresses known in prior art. Thus, with less strings needed to form a mattress according to the invention, the same mattress becomes easier and less expensive to manufacture. This may be combined with separations within strings, as in WO 02/44077, said document hereby incorporated by reference.

A similar, and actually even more pronounced, improvement in softness and individual resilience of the springs have been found in mattresses where stretch openings are provided, but where the separation between the springs are not increased. Thus, the improvement in individual resilience is apparently primarily related to the provision of the stretch openings per se.

It is per se known in the art to incorporate an opening in casings of pocket mattresses, but in different ways than presently proposed and for totally different purposes. For example, U.S. Pat. No. 1,455,847 discloses a mattress which contains springs in pockets, for which elongated pocket casing openings are provided. However, in U.S. Pat. No. 1,455,847 only one single elongated opening is provided for each spring casing. Additionally, the opening of this known mattress is provided for a different purpose, viz. to facilitate the insertion of a spring into a pocket, by compressing the spring between the thumb and index/middle fingers and insert the spring through the stretch opening. Thus, the single opening needs to have a sufficient extension, great enough for the insertion of a compressed spring. In the present invention on the other hand, the casing stretch openings appear, in contrast to a single opening, in plurality, i.e. at least two, stretch openings, which are displaced in relation to each other in a lengthwise direction of the spring. Hereby, several advantages are surprisingly obtained, as discussed in the foregoing, which advantages are neither obtained nor foreseeable from the prior art solutions.

It is preferred that the extension of each of the stretch openings is smaller than the diameter of the spring enclosed within the corresponding casing. It is particularly preferable to let the extension be smaller than half the diameter of the spring.

Small stretch opening extensions in relation to the diameter of the spring minimize the risk of the spring accidentally escaping one of the stretch openings.

It is likewise preferred that the plurality of stretch openings, for each of the at least one casing, are arranged on both sides of the corresponding string or alternatively on only one of the two sides. According to a third alternative, for each of the at least one casing, the plurality of stretch openings are arranged on at least one, and on preferably two, and most preferably on all four of the corresponding quadrant casing sections, defined in between interconnections of adjacent casings within the string and interconnections of the string to other strings.

Accordingly, there are several possibilities regarding where to position the stretch openings in the casings, and the arrangements can vary between different casings, should it be desirable.

It is preferred, that at least some of the stretch openings have different extensions. Further, the mattress can comprise at least two casings with a plurality of stretch openings, for which at least some of the casings have different stretch opening extensions. Further, the casings having different stretch opening extensions can be arranged in different strings.

The properties of the stretch opening extensions contributes to the casing stretching characteristics. In this manner, it is possible by varying the stretch opening extensions in between casings or in between strings, to let the casing characteristics and consequently the flexing characteristics of corresponding springs differ in between different zones of the mattress. Hereby, zones of varying resilience properties can easily be obtained.

The mattress can comprise at least two casings with a plurality of stretch openings, for which at least some of the casings have a different number of stretch openings. It is further preferred, that the casings having different number of stretch openings are arranged in different strings. Equivalent to the properties of the stretch opening extensions contributing to the casing stretching characteristics as discussed above, so does the number of stretch openings. Consequently, by varying the number of stretch openings in between casings within strings or in between strings, it is possible to let the casing characteristics and consequently the flexing characteristics of corresponding springs differ in between different zones of the mattress.

Taken together, it is particularly preferred that the mattress comprises zones having different properties, which zones are distributed across the surface of the mattress. The casings of the zones differs in terms of at least one of the number of stretch openings, the extensions of the stretch openings and the positioning of the stretch openings. Zones provided by means of casings having numbers of stretch openings may in the simplest case be zones with casings without stretch openings, i.e. where the number of stretch openings is zero, and zones in which the casings are provided with stretch openings. However, more complex embodiments are also feasible, where at least some zones differ in the non-zero number of stretch openings for each casing.

The stretch openings may be arranged to extend in any directions, such as transversely or partly transversely to the lengthwise direction of the spring. The stretch openings may also extend in different directions. However, it is preferred that some of, and preferably all of, the stretch openings have an elongated form in a lengthwise direction of the spring.

The elongated form of the stretch opening in a lengthwise direction of the spring, contributes to the increased stretching characteristics of the casing material holding the spring. As discussed in the foregoing, the stretch openings allow less casing fabric to be needed in a lengthwise direction of the spring to obtain the equivalent stretching characteristics to a casing lacking the stretch openings, and giving the stretch openings an elongated form in a lengthwise direction of the springs is a contributing factor. However, it is also feasible to use other forms, such as circular or oval stretch openings.

It is likewise preferred that the stretch openings are arranged in at least one line extending in a lengthwise direction of the spring, each line comprising at least two stretch openings. The stretch openings can further be arranged in at least two lines and preferably, the stretch openings of at least two adjacent lines are displaced in a lengthwise direction of the spring.

Equivalent to the elongated form of the stretch openings contributing to the increased stretching characteristics of the casing material holding the spring as discussed in the foregoing, so does displacement of the stretch openings of two adjacent lines. Positioning adjacent stretch openings in displaced relation to one another, thereby forming a net-like structure, improves the casing stretch of the spring, thus allowing less fabric to be required for each casing comprising stretch openings.

Additionally, it is preferred that at least two of the stretch openings are displaced to an extent not to overlap each other in a lengthwise direction of the spring.

Positioning stretch openings such that their extensions do not overlap each other, further contributes to optimizing the casing stretch of the spring unit, thus allowing a minimum of fabric being required for each casing comprising stretch openings.

Even though coil springs of many different sizes could be used in conjunction with the present invention, and in principal any desired spring size, large or small, may be used, it is preferred that the spiral turn of the springs has a diameter size of 2-10 cm, and preferably about 6 cm.

Likewise, even though fabrics such as various types of plastic materials or non-weldable textile fabrics, such as cotton fabrics, could equally well be used, the casing is preferably made from a weldable textile.

It is preferred that the stretch openings are arranged to provide adjustable extension of the mattress, in the direction perpendicular to the lengthwise direction of the strings and the surface of the mattress.

Correspondingly, is it preferred, according to a fourth aspect of the invention, that a bed with adjustable extension in at least one of the length and width directions, is provided.

Hereby, similar advantages as discussed above in reference to the previous aspects of the invention may be achieved. In particular, the bed having these adjustment capabilities allows the dimensions of the mattress to vary, and enables the user of the mattress to adjust the dimensions according to his preferences, by stretching the strings further apart or, inversely, reduce the distance between the strings. By providing means for adjusting the mattress to be wider or longer, to suit the users present needs, the mattress can be adapted to various situations. For instance, a mattress with adjustable dimensions is favorable in a truck cab, in which a chauffeur mattress preferably takes up minimum space during driving, and is allowed to be expanded during resting. For instance, it would hereby be possible to change from a 90 cm wide beds to one of 120 cm, by extending the distance between the strings of the mattress.

Varying the distance between the strings also affects the firmness of the mattress. By extending the distance between the strings, the mattress becomes softer as the strings, and consequently the springs, are placed further apart. Compared to when the strings are placed closer to each other, the weight of the user is distributed on fewer springs, consequently each affected spring is exposed to more weight, thus resulting in the mattress being softer. The varying characteristics as a result of varying the distance between the strings, allows the user to adjust the firmness of the mattress to his preferences. Thus, by extending the distance between the strings, the user can adjust the mattress to be softer, and, inversely, by reducing the distance, he can increase the firmness of the mattress.

Consequently, utilizing the abilities of stretching the casings to various extents enables the mattress to fit the present situation by, after assembly, adjusting the distance between the strings.

Preferably, the provision of stretch openings into the interior of the casing, is achieved by cutting. Correspondingly, it is preferred that the means for providing the stretch openings in the casings comprises cutting means.

The provision of stretch openings in the casings is preferably performed prior to the step where the strings are connected side by side. It is particularly preferred, that the provision of stretch openings is performed prior to the step where the strings are enclosed in the casings.

In this manner, the stretch openings into the interior of the casings are provided early on in the manufacturing process, thus facilitating the overall manufacturing process.

Other aspects, benefits and advantageous features of the invention will be apparent from the following description and claims.

BRIEF DESCRIPTION OF THE DRAWINGS

The invention will be more apparent from the accompanying drawings, which are provided by way of non-limiting examples.

DETAILED DESCRIPTION OF PREFERRED EMBODIMENTS OF THE INVENTION

Figure 1A:
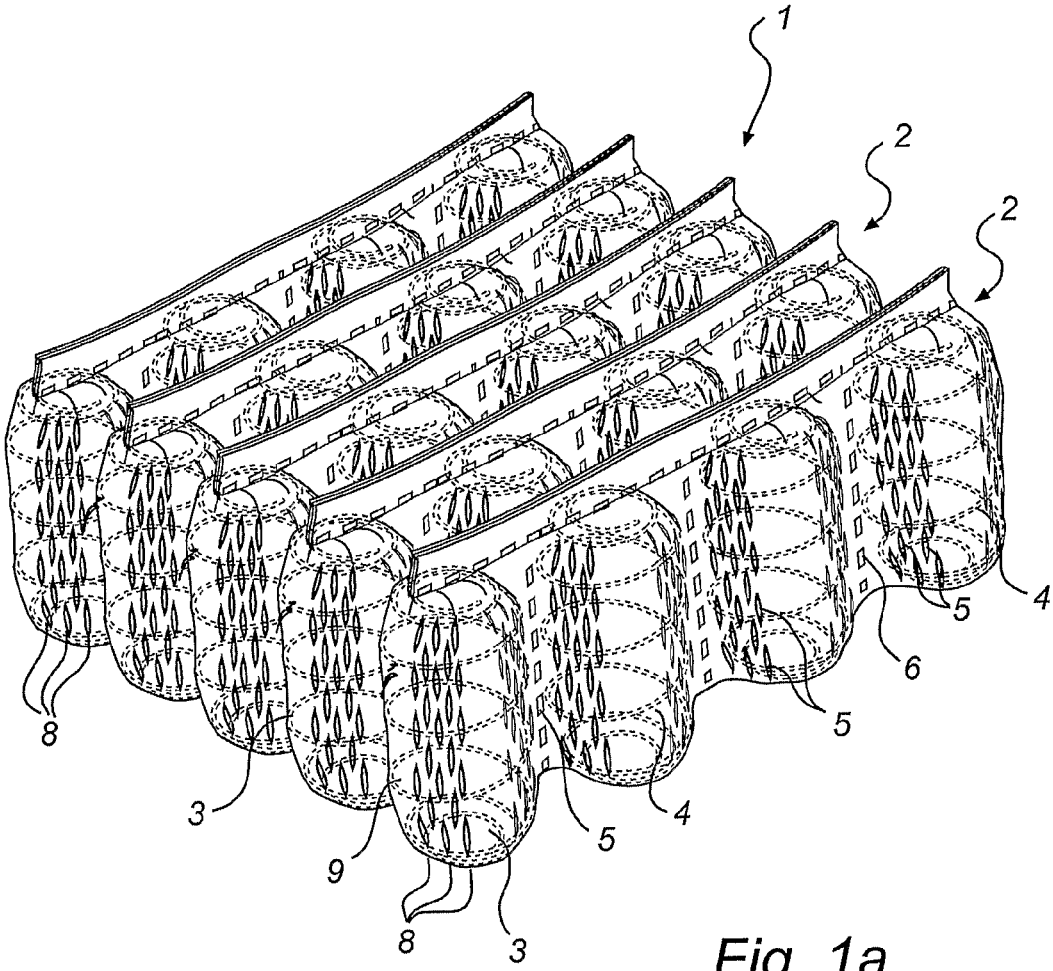
FIG. 1*a* shows a portion of a spring mattress according to one embodiment of the present invention.

FIG. 1*a* shows a portion of a pocket spring mattress 1 in accordance with an embodiment of the present invention in an exemplifying manner.

The mattress 1 comprises a plurality of strings 2 interconnected side by side 7, and each string 2 comprises a plurality of continuous casings 3. Within each casing 3, i.e. pocket, there is a coil spring 4 enclosed, the springs 4 having a spiral turn 9 with a diameter of approximately 2 to 10 cm, and preferably 6 cm, and in the presently illustrated embodiment, a plurality of casing stretch openings 5 are provided. However, not all casings 3 need to be provided with stretch openings 5.

Figure 1B:
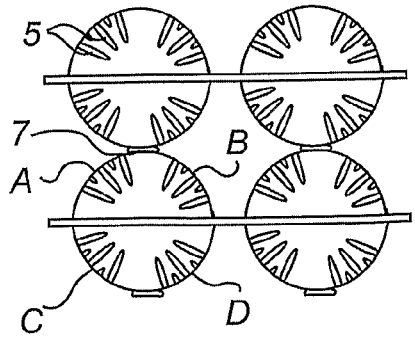
FIG. 1*b* shows from a top view casing sections defined in between interconnections of adjacent casings within a string and interconnections of the string to other strings, in the mattress of FIG. 1*a*.

In the illustrated example, as shown in FIG. 1*b*, the stretch openings 5 are positioned on all four of quadrant sections A, B, C, D defined in between the interconnections 6 of adjacent casings 3 within the string 2 and interconnections 7 of the string 2 to other strings 2. However, all possible combinations of positioning for the stretch openings are feasible, e.g. alternatives such as positioning stretch openings only on sections A and C, or on sections B and D, or only on section D or on the three sections A, B and D.

The extensions of the stretch openings 5 are smaller than the diameter of the springs 4 enclosed within the corresponding casings 3, and in this embodiment smaller than half the diameter.

Each stretch opening 5 has, in this illustrated example, an elongated form in a lengthwise direction of the springs 4.

In the illustrated example the stretch openings 5 are further arranged in a plurality of lines 8 extending in the lengthwise direction of the springs 4, and each line 8 comprises a plurality of stretch openings 5. Adjacent lines 8 are displaced in the lengthwise direction of the springs 4, thereby forming a net-like structure.

The stretch openings 5 can be displaced to an extent not to overlap each other in a lengthwise direction of the spring 2, but that is not the case in this example Further in this embodiment, all stretch openings 5 have the same extension in terms of length and direction, but alternatively, the stretch opening extensions 5 can vary for the casings 3 in the different strings 2, between the casings 3 in the same string 2 and even between the stretch openings 5 on the same casing 3.

Correspondingly, in this embodiment, all casings 3 have the same number of stretch openings 5, but alternatively, the number of stretch openings 5 can vary for the casings 3 in the different strings 2 and even between the casings 3 in the same string 2.

Figure 4A:
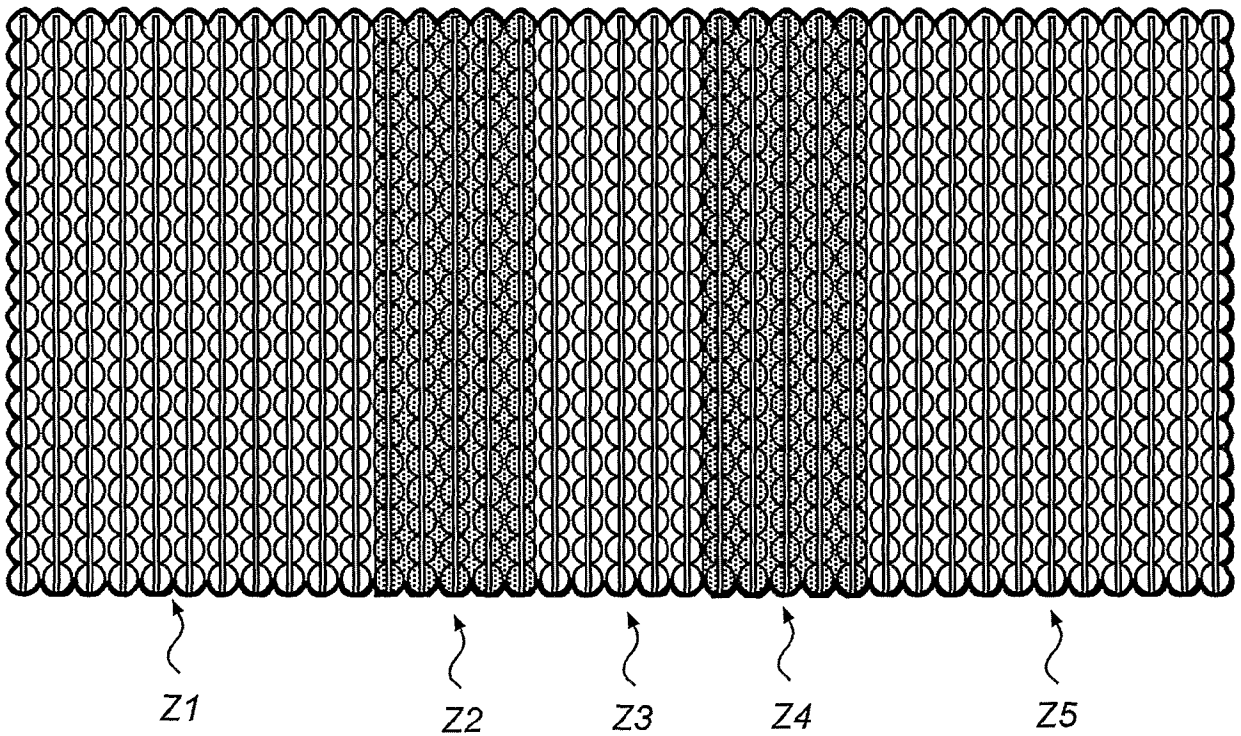
FIG. 4*a* is a perspective view of an embodiment of the invention, showing a spring mattress comprising zones for which strings the stretch opening characteristics differ.
Figure 4B:
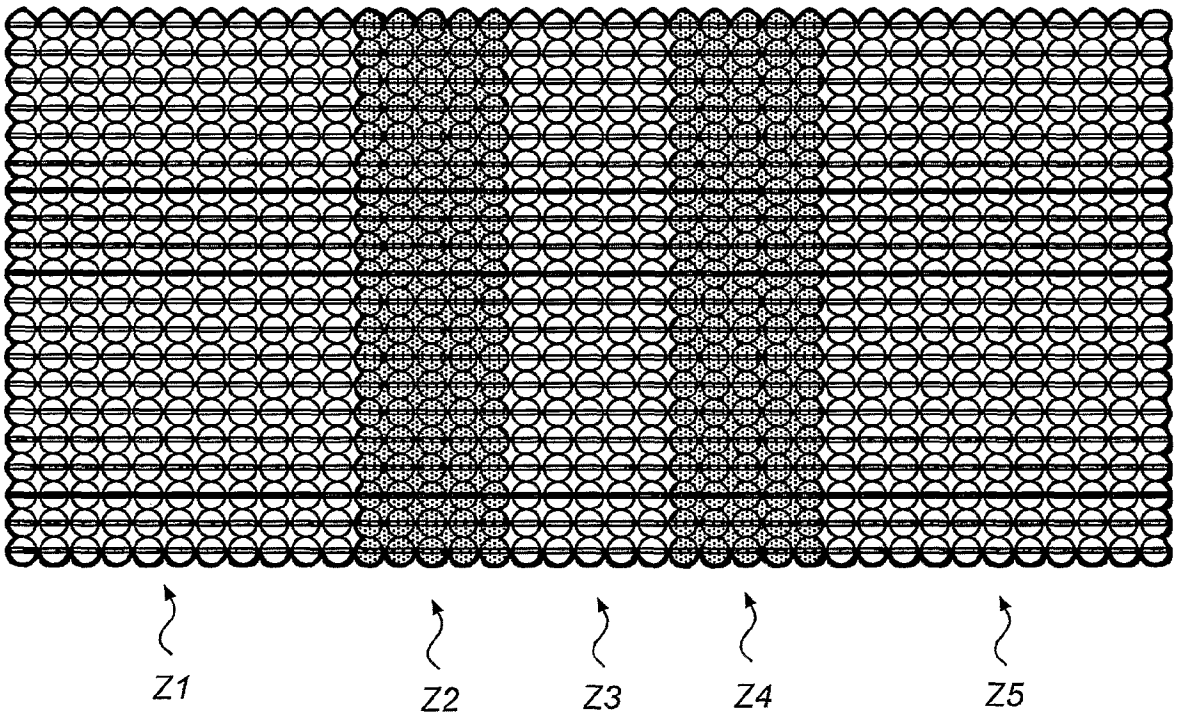
FIG. 4*b* is a perspective view of a similar spring mattress comprising zones as the one illustrated in FIG. 4*a*, but with a different orientation of the strings.

Varying either the number of stretch openings 5, the extensions of the stretch openings 5 or the positioning of the stretch openings 5 may result in various casing characteristics. The implementation of utilizing various characteristics in different sections of the mattress 1 can be seen in the illustrative example of FIG. 4*a*, which shows a mattress 1 comprising different zones $Z_1$, $Z_2$, $Z_3$, $Z_4$, $Z_5$ distributed across the surface. The zones $Z_1$, $Z_2$, $Z_3$, $Z_4$, $Z_5$ are formed of strings 2, wherein the strings 2 within the different zones $Z_1$, $Z_2$, $Z_3$, $Z_4$, $Z_5$ have differing casing stretch opening 5 characteristics. In the illustrative example, the strings 2 run in the short side direction of the mattress 1. Alternatively, the mattress 1 can comprise strings 2 running in the lengthwise direction, consequently enabling the mattress 1 to have zones $Z_1$, $Z_2$, $Z_3$, $Z_4$, $Z_5$ in the lengthwise instead of the short side direction by using strings with different properties. Still further, zones may be provided by means of providing strings comprising casings with two or more different stretch opening characteristics. Such an exemplary embodiment is schematically illustrated in FIG. 4*b*, in which the same zones $Z_1$, $Z_2$, $Z_3$, $Z_4$, $Z_5$ as in FIG. 4*a* are formed by a plurality of strings 2 running in the long side direction of the mattress 1, and each having casings with two or more different casing stretch opening characteristics.

Figure 2:
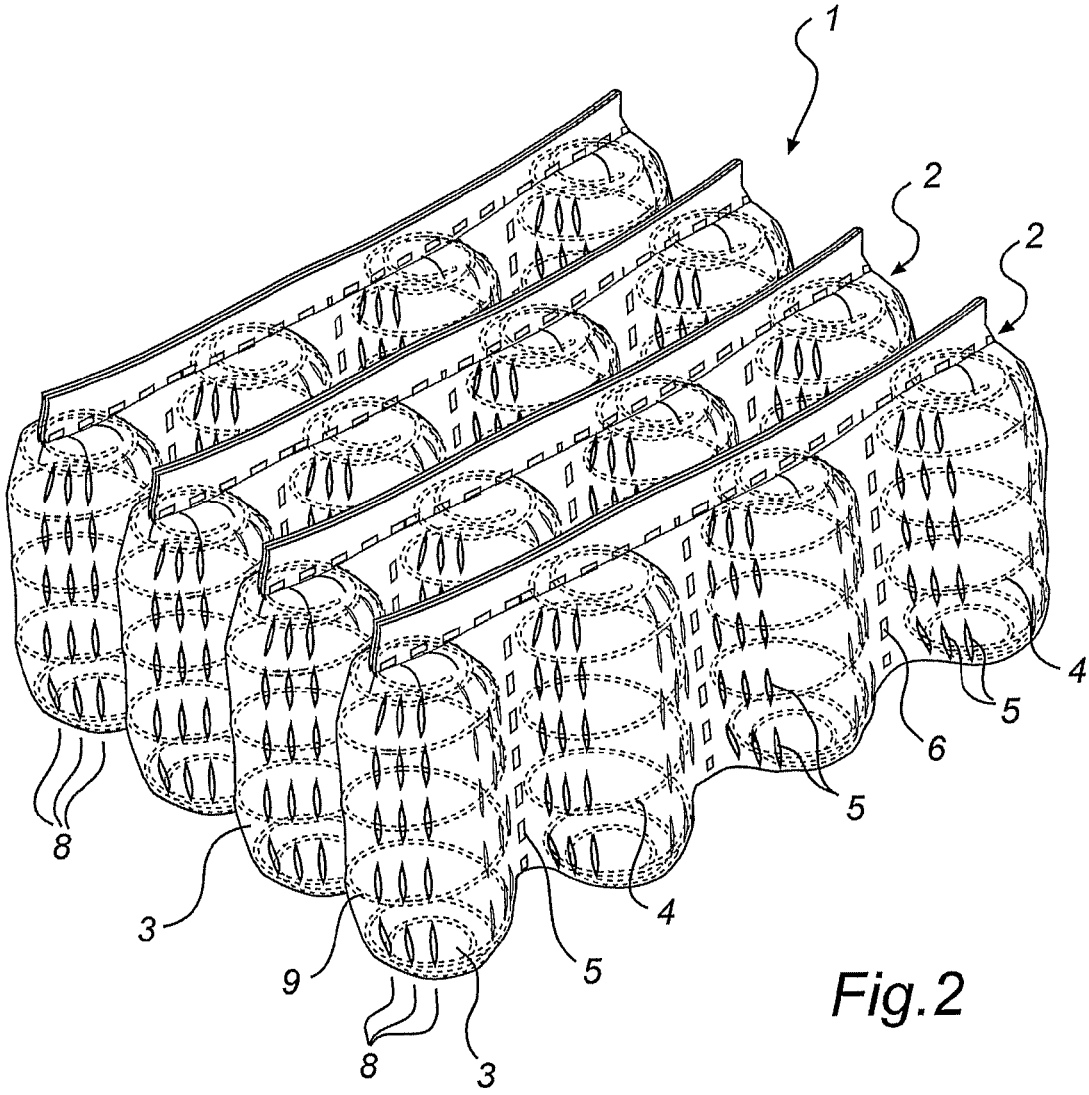
FIG. 2 shows a portion of a spring mattress according to an alternative embodiment of the invention.

FIG. 2 shows an alternative embodiment of the invention. In this illustrative example, the stretch openings 5 arranged in a plurality of lines 8 extending in the lengthwise direction of the springs 4 are not, as in FIG. 1, displaced in the lengthwise direction of the springs 4.

Figure 3:
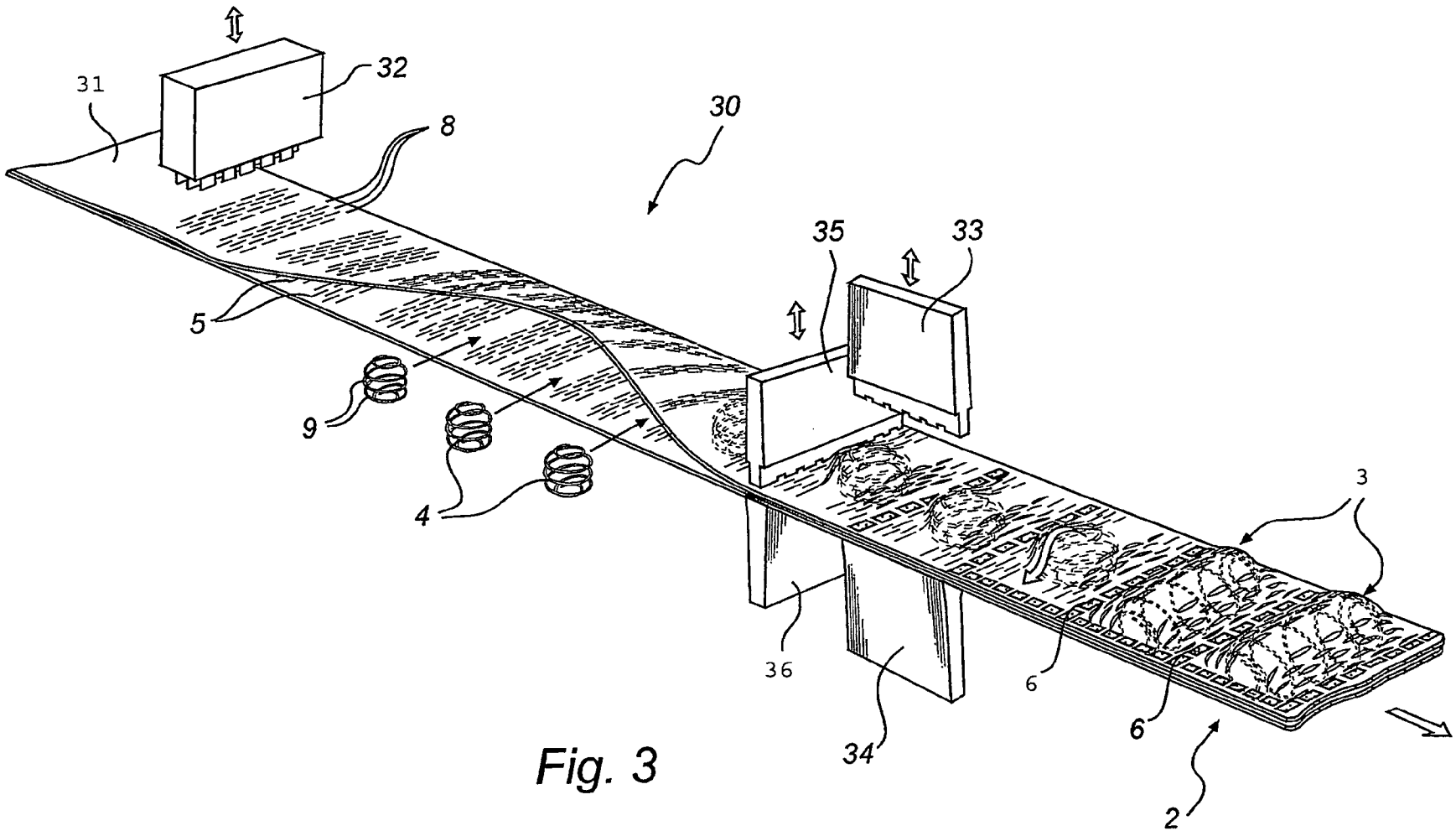
FIG. 3 shows a manufacturing device used during manufacturing of a spring mattress according to an embodiment of the invention.

FIG. 3 illustrates in an exemplifying manner a manufacturing device 30 for manufacturing of a spring mattress 1 according to the invention. In brief, the strips 2 of interconnected, cover-enclosed springs 4 are manufactured automatically, where after the strips 2 are cut in suitable lengths and interconnected to one another side by side, arranged in successive rows, to form mattresses 1. The interconnection 7 could for instance be effected by welding or gluing or by clamps or Velcro tape.

The illustrated device in FIG. 3 comprises means 32 for providing at least one of the strings 2 with a plurality of stretch openings 5 into the fabric 31, which folded fabric 31 later in the process will be separated into casings 3.

The material of the casing 3 in the illustrated example is made from weldable textile fabric 31, but the invention also allows other materials to be used.

The means 32 for providing the stretch openings 5 in the illustrated example comprises, but is not limited to, cutting means 32, such as for instance cutting blades or cutting by heat or water. The means 32 for providing the stretch openings 5, can for instance comprise one row of cutting blades, which group of blades 32 provides the casing stretch opening line 7, and if more than one line 7 per casing 3 is requested, move the group of cutting blades 32 in the lengthwise direction of the string 2, to provide the remaining stretch opening lines 7. This relative movement between the fabric 31 and the row of cutting blades 32 can be accomplished by moving the means 32 as described, or alternatively, by moving the fabric 31 in the lengthwise direction of the string 2. Further, another alternative with regards to the design of the cutting means 32, could be to let the means 32 comprise only one cutting blade, which blade 32 provides the casing stretch openings 5 one by one, moving in the short side direction of the string 2. If more than one line 7 per casing 3 is requested, the cutting blade 32 is moved in the lengthwise direction of the string 2 to repeat the provision of stretch openings 5 one by one, moving in the short side direction of the string 2. Similar to above, the relative movement between the fabric 31 and the cutting blade 32, in both the lengthwise and short side direction of the string 2, can be accomplished by moving the blade 32 as described, or alternatively, by moving the fabric 31.

The stretch openings 5 are in this embodiment provided prior to the springs 4 being enclosed within their respective casings 3, but can alternatively be provided anytime throughout the manufacturing process.

Further in the illustrative example, it is shown that after a spring 4 is inserted in between the layers of the fabric, the spring 4 is enclosed by means 33, 34, 35, 36 in its casing between the interconnections 6 of adjacent casings 3 within the string 2 and a closing seal in the open portion of the casing 3. The means 35, 36 for interconnecting 6 adjacent casings 3 could for instance provide a spot-welded seam or a continuous welding line. Other types of interconnections 6 are also possible, such as one or several stitched seams.

Figure 5:
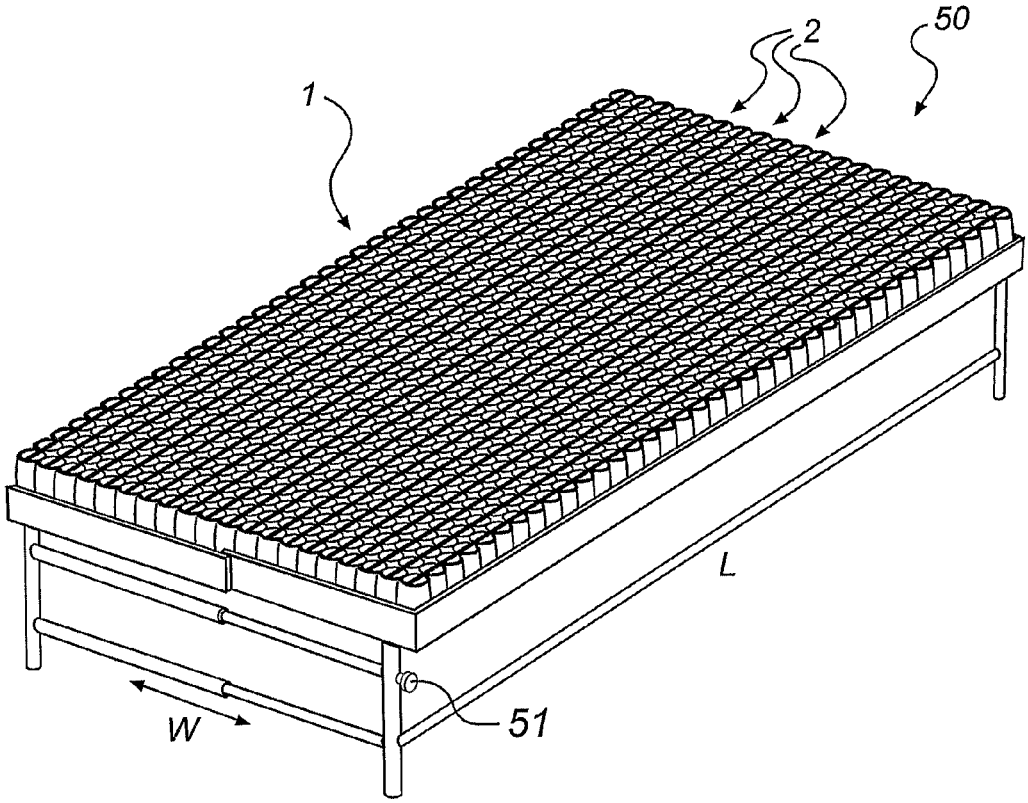
FIG. 5 shows a bed with adjustable width according to an embodiment of the present invention.

After the springs 4 are enclosed and turned so that the they are placed lengthwise within respective casings 3, the string 2 is due for interconnection 7 with other strings 2, to form a mattress of the inventive concept 1. FIG. 5 shows a bed 50 with adjustable width according to an embodiment of the present invention. Adjusting means 51 allows user of the mattress 1 to adjust the extension of the mattress 1, in the direction perpendicular to the lengthwise direction of the strings 2 and the surface of the mattress. In the illustrated example, the strings 2 run in the lengthwise direction L of the mattress 1, thus enabling the width W of the mattress 1 to be adjusted. Alternatively, the strings can run in the short side direction W, which instead will result in the mattress being adjustable lengthwise L.

The mattress according to the present invention provides a number of unexpected advantages, as has been discussed in the foregoing. For example, the individual resilience and the softness of the mattress is greatly improved by means of the provision of the stretch openings. This has also been confirmed in comparative experiments. For example, one test for measuring the comfort and resilience used a round plate of diameter 97 mm and mounted through a ball joint, which was pressed vertically downwards onto the mattress surface, and the indentation or depression was measured. This measurement was repeated on different measurement positions distributed over the mattress surface, and with different forces applied to the plate. Based on these measurements an F-value indicating the general appearance of the mattress as being stiff/soft was calculated for each mattress. This F-value is essentially based on an average value for the measurements at applied forces ranging between 4 N and 200 N. In these experiments, it was found that mattresses with stretch openings were about 20% softer (i.e. a 20% higher F-value) than mattresses without such stretch openings, but otherwise identical to the mattresses with stretch openings. Accordingly, it is deduced that a significant improvement in the softness and individual resilience of the pockets is achieved solely due to the provision of the above-discussed stretch openings.

The invention has been described above by way of embodiments. Several variants of the invention are, however, conceivable. For instance, as mentioned above, stretch openings does not necessarily need to be provided on all casings in the mattress, but can be present on only one or a few. Furthermore, stretch openings can be positioned on the casing sections using various combinations, the number and extensions of the stretch openings can vary, as well as their form and how they are arranged. The mattress can comprise zones of various casing characteristics, or be uniform throughout the mattress. Furthermore, different types of casing material and spring sizes can be used. The mattress as well as the method and device for manufacturing thereof can be designed in other ways. Such and other similar obvious alternatives must be considered to be comprised by the invention as defined by the appended claims.

The invention claimed is:

1. A spring mattress, comprising:

a plurality of strings interconnected side by side, each of the plurality of strings including a plurality of continuous casings and each of the casings including a coil spring, at least one of the casings in at least one of said plurality of strings including a plurality of stretch openings into an interior of the at least one casing, wherein at least some of said plurality of stretch openings are displaced in relation to each other in a lengthwise direction of said coil spring.

2. A spring mattress according to claim 1, wherein an extension of each of said stretch openings is smaller than a diameter of said coil spring enclosed within a corresponding casing.

3. A spring mattress according to claim 1, wherein an extension of each of said stretch openings is smaller than half a diameter of said coil spring enclosed within a corresponding casing.

4. A spring mattress according to claim 1, wherein such a plurality of stretch openings, for each of said at least one casing, are arranged on both sides of a corresponding string.

5. A spring mattress according to claim 1, wherein such a plurality of stretch openings, for each of said at least one casing, are arranged on only one of the two sides of a corresponding string.

6. A spring mattress according to claim 1, wherein said stretch openings, for each of said at least one casing, are arranged on at least one of corresponding casing sections, defined in between interconnections of adjacent casings within the string and interconnections of the string to other strings.

7. A spring mattress according to claim 6, wherein said stretch openings, for each of said at least one casing, are arranged on two of corresponding casing sections, defined in between interconnections of adjacent casings within the string and interconnections of the string to other strings.

8. A spring mattress according to claim 6, wherein said stretch openings, for each of said at least one casing, are arranged on all four of corresponding casing sections, defined in between interconnections of adjacent casings within the string and interconnections of the string to other strings.

9. A spring mattress according to claim 1, wherein at least some of said stretch openings have different extensions.

10. A spring mattress according to claim 9, wherein said mattress comprises at least two casings with a plurality of stretch openings, and wherein at least some of said casings have different stretch opening extensions.

11. A spring mattress according to claim 10, wherein said casings having different stretch opening extensions are arranged in different strings.

12. A spring mattress according to claim 1, wherein said mattress comprises at least two casings with a plurality of stretch openings and wherein at least some of said casings have a different number of stretch openings.

13. A spring mattress according to claim 12, wherein said casings having different numbers of stretch openings are arranged in different strings.

14. A spring mattress according to claim 1, wherein said mattress comprises zones having different properties, the zones being distributed across the surface of the mattress, the casings of said zones differing in terms of at least one of the number of stretch openings, the extensions of said stretch openings and the positioning of said stretch openings.

15. A spring mattress according to claim 1, wherein some of said stretch openings have an elongated form in a lengthwise direction of said coil spring.

16. A spring mattress according to claim 15, wherein all of said stretch openings have an elongated form in a lengthwise direction of said spring.

17. A spring mattress according to claim 1, wherein said stretch openings are arranged in at least one line extending in a lengthwise direction of the coil spring, each line comprising at least two stretch openings.

18. A spring mattress according to claim 17, wherein said stretch openings are arranged in at least two lines.

19. A spring mattress according to claim 18, wherein the stretch openings of at least two adjacent lines are displaced in a lengthwise direction of said coil spring.

20. A spring mattress according to claim 1, wherein at least two of said stretch openings are displaced to an extent not to overlap each other in a lengthwise direction of said coil spring.

21. A spring mattress according to claim 1, wherein the spiral turn of said coil springs has a diameter size of 2-10 cm.

22. A spring mattress according to claim 21, wherein the spiral turn of said coil springs has a diameter size of about 6 cm.

23. A spring mattress according to claim 1, wherein said casing is made from a weldable textile fabric.

24. A spring mattress according to claim 1, wherein said stretch openings are arranged to provide adjustable extension of said mattress in a direction perpendicular to the lengthwise direction of said strings and the surface of said mattress.

25. A bed with adjustable extension in at least one of a length and width directions, comprising a mattress according to claim 1.

26. A method of manufacturing a spring mattress, comprising:

enclosing springs in casings in continuous strings;

interconnecting the strings side by side; and providing at least one of the casings in at least one of the strings with a plurality of stretch openings into an interior of the at least one casing, wherein at least some of the plurality of stretch openings are displaced in relation to each other in a lengthwise direction of the coil spring.

27. A method according to claim 24, wherein the providing of stretch openings in the casings is achieved by cutting.

28. A method according to claim 24, wherein the providing of stretch openings in the casings is performed prior to the strings being interconnected side by side.

29. A method according to claim 24, wherein the providing of stretch openings in the casings is performed prior to the coil springs being enclosed in the casings.

30. A device for manufacturing a spring mattress, comprising:

means for enclosing coil springs in continuous casings to form strings;

means for interconnecting strings side by side; and means for providing at least one of the casings in at least one of the strings with a plurality of stretch openings into an interior of the at least one casing, wherein at least some of the plurality of stretch openings are displaced in relation to each other in a lengthwise direction of the coil spring.

31. A device according to claim 29, wherein the means for providing at least one of the casings in at least one of the strings with a plurality of stretch openings comprises a cutting device.

* * * * *